US006745704B2

(12) United States Patent
Carter et al.

(10) Patent No.: US 6,745,704 B2
(45) Date of Patent: Jun. 8, 2004

(54) ONE-PIECE INTERMEDIATE BULK CONTAINER SPILL STATION

(75) Inventors: Glen Alan Carter, Mattoon, IL (US); John Carl Norman, Decatur, IL (US); Alan Girard, Madison, IN (US)

(73) Assignee: Justrite Manufacturing Company, L.L.C., Mattoon, IL (US)

( * ) Notice: Subject to any disclaimer, the term of this patent is extended or adjusted under 35 U.S.C. 154(b) by 50 days.

(21) Appl. No.: 10/167,124

(22) Filed: Jun. 11, 2002

(65) Prior Publication Data

US 2003/0226479 A1 Dec. 11, 2003

(51) Int. Cl.[7] ..... B65D 19/44
(52) U.S. Cl. ..... 108/55.1
(58) Field of Search ..... 108/55.1, 55.3, 108/51.11, 24; 206/386, 595

(56) References Cited

U.S. PATENT DOCUMENTS

| | | | | |
|---|---|---|---|---|
| 3,636,888 A | | 1/1972 | Angelbeck, Jr. | |
| 3,776,435 A | * | 12/1973 | Smith | 222/566 |
| 3,948,190 A | | 4/1976 | Cook, III et al. | |
| 3,993,168 A | | 11/1976 | Kubick | |
| 4,007,694 A | * | 2/1977 | Fowler et al. | 108/55.1 |
| 4,263,855 A | | 4/1981 | Lawlor | |
| 4,516,677 A | | 5/1985 | Rowland et al. | |
| 4,930,632 A | * | 6/1990 | Eckert et al. | 206/386 |
| 5,020,667 A | | 6/1991 | Bush | |
| 5,036,976 A | | 8/1991 | Sechler et al. | |
| 5,092,251 A | | 3/1992 | Hamaker et al. | |
| 5,133,460 A | * | 7/1992 | Shuert | 206/600 |
| 5,147,039 A | * | 9/1992 | Sechler et al. | 206/386 |
| 5,249,699 A | * | 10/1993 | Williams | 220/571 |
| 5,254,798 A | * | 10/1993 | Zoback | 588/259 |
| 5,307,931 A | | 5/1994 | Gillispie et al. | |
| 5,392,911 A | | 2/1995 | Gillispie et al. | |
| 5,429,236 A | * | 7/1995 | Evans | 206/386 |
| 5,562,047 A | | 10/1996 | Forney et al. | |
| 5,579,700 A | * | 12/1996 | Nuechterlein et al. | 108/55.1 |
| 5,588,373 A | | 12/1996 | Bacskay | |
| 5,615,608 A | | 4/1997 | Shaw et al. | |
| 5,642,834 A | | 7/1997 | Shaw et al. | |
| 5,704,476 A | | 1/1998 | Abbott | |
| 5,769,003 A | | 6/1998 | Rose et al. | |
| 5,829,362 A | | 11/1998 | Evans et al. | |
| 5,857,416 A | | 1/1999 | Donnell, Jr. et al. | |
| 6,311,628 B1 | * | 11/2001 | Smith et al. | 108/55.1 |
| 6,349,656 B1 | * | 2/2002 | Mitchell | 108/57.13 |
| 6,382,108 B1 | * | 5/2002 | Stanek et al. | 108/55.1 |

FOREIGN PATENT DOCUMENTS

EP 3738610 * 6/1990

OTHER PUBLICATIONS

New Pig Leak & Spill Absorbents, www.newpig.com, printed Jul. 10, 2002 (6 pages).
Lab Safety Supply, www.labsafety.com, printed Jul. 10, 2002(14 pages).
New Pig catalog pp. 304 and 305, printed 2001.
C&H Distributors catalog pp. 370 and 375, printed 2001.
Conney Safety catalog p. 325, printed 2001.
Lab Safety supply catalog p. 2343, printed 2001.

* cited by examiner

*Primary Examiner*—Jose V. Chen
(74) *Attorney, Agent, or Firm*—Leydig, Voit & Mayer, Ltd.

(57) ABSTRACT

Disclosed is a one-piece spill station with integral support for an intermediate bulk container (IBC). Connected to and surrounding the periphery of a bottom wall is a containment wall that rises generally vertically. One or more support columns rise from the bottom wall and are topped with bearing areas that accept the weight of an IBC. The IBC bearing areas are located high enough above the top edge of the containment wall to allow a forklift to place an IBC onto the bearing areas. The bottom wall, containment wall, and support columns define a spill containment reservoir. For additional strength and rigidity, ribs are molded into the containment wall and into the walls of the support columns. In an embodiment of the invention, the support columns are strengthened either by making them larger at their bases than at their IBC bearing areas or by curving their walls.

8 Claims, 8 Drawing Sheets

Section G-G

ONE-PIECE INTERMEDIATE BULK CONTAINER SPILL STATION

TECHNICAL FIELD

The present invention relates generally to stations for supporting intermediate bulk containers, and, more particularly, to one-piece stations for containing spills of hazardous materials.

BACKGROUND OF THE INVENTION

Intermediate bulk containers (IBCs) are large containers, often made of plastic or fiberglass, that are used in manufacturing environments to hold and dispense large quantities (often, 300 to 1200 gallons) of liquids. They are very heavy when full and so are often moved by cranes or placed on pallets to allow for forklift or hand truck transport.

Sometimes, the liquid held by an IBC is hazardous if it enters the environment or comes into contact with humans. Thus, it is important (and often required by law) that a mechanism be put in place to contain possible spills of the IBC's contents. To do this, the IBC is placed over a spill containment reservoir, typically a large tub made of corrosion-resistant plastic. The IBC is supported above the spill containment reservoir by a removable platform, usually either a metal frame or a plastic grill. The combination of containment reservoir and support platform is called an IBC "spill station." When combined with a forklift pallet, the spill station becomes an IBC "spill pallet."

An IBC support platform must be strong enough to support the enormous weight of a full IBC. The spill containment reservoir must be able to accommodate a significant amount of spilled liquid, often, by law, up to 100% of the capacity of the IBC. These factors tend to endow IBC spill stations with such large sizes and weights that manufacturing, using, and storing them all become awkward operations.

A manufacturer often produces the separate spill containment reservoirs and support platforms in separate assembly areas due to differences in the materials or in the manufacturing technologies used. This increases the cost of manufacturing the spill station as does maintaining separate inventories and coordinating shipping of complete spill stations to customers.

The customer inherits the manufacturer's problems of maintaining storage areas for the separate IBC spill station components. When a spill station is needed, all of these storage areas are accessed. In addition, the weight and size of a separate support platform make positioning it within a spill containment reservoir an awkward, and often a multi-person, task. Once an IBC spill station is assembled and in use, the view to the bottom of the containment reservoir may be partially blocked by a separate support grill. This blocked view may prevent early detection of a slow IBC leak and may thus lead in time to a much larger spill. In addition, the separate support grill prevents a worker from cleaning out the IBC spill station with the support grill in place. Instead, the grill and the IBC resting on it must be removed before hosing out the spill station.

What has been needed is an IBC spill station that maintains the utility of existing designs but simplifies the manufacture, use, and storage of such devices.

SUMMARY OF THE INVENTION

The above problems and shortcomings, and others, are addressed by the present invention, which can be understood by referring to the specification, drawings, and claims. The present invention is a one-piece spill station with integral support for an IBC. Connected to and surrounding the periphery of a bottom wall is a containment wall that rises generally vertically. One or more support columns rise from the bottom wall and are topped with bearing areas that accept the weight of an IBC. The IBC bearing areas are located high enough above the top edge of the containment wall to allow a forklift to place an IBC on the bearing areas. The bottom wall, containment wall, and support columns define a spill containment reservoir. For additional strength and rigidity, ribs are molded into the containment wall and into the walls of the support columns.

In an embodiment of the invention, the support columns are strengthened either by making them larger at their bases than at their IBC bearing areas or by curving their walls. One or more dispensing stations may be formed into the one-piece spill station. In some embodiments, additional support columns are provided for a second IBC that sits next to the first IBC. A drainage aperture may be machined through the containment wall to allow spilled liquids to be drained out of the spill station.

The one-piece IBC spill station is preferably molded from a corrosion-resistant, non-porous material such as linear low density polyethylene. Because of the size and complicated form of the spill station, rotational molding is the preferred manufacturing technique. To ease the removal of the spill station from its manufacturing mold, the containment wall, support column walls, and strengthening ribs may be angled slightly away from the vertical.

BRIEF DESCRIPTION OF THE DRAWINGS

While the appended claims set forth the features of the present invention with particularity, the invention, together with its objects and advantages, may be best understood from the following detailed description taken in conjunction with the accompanying drawings of which:

DETAILED DESCRIPTION OF THE INVENTION

Figure 1:
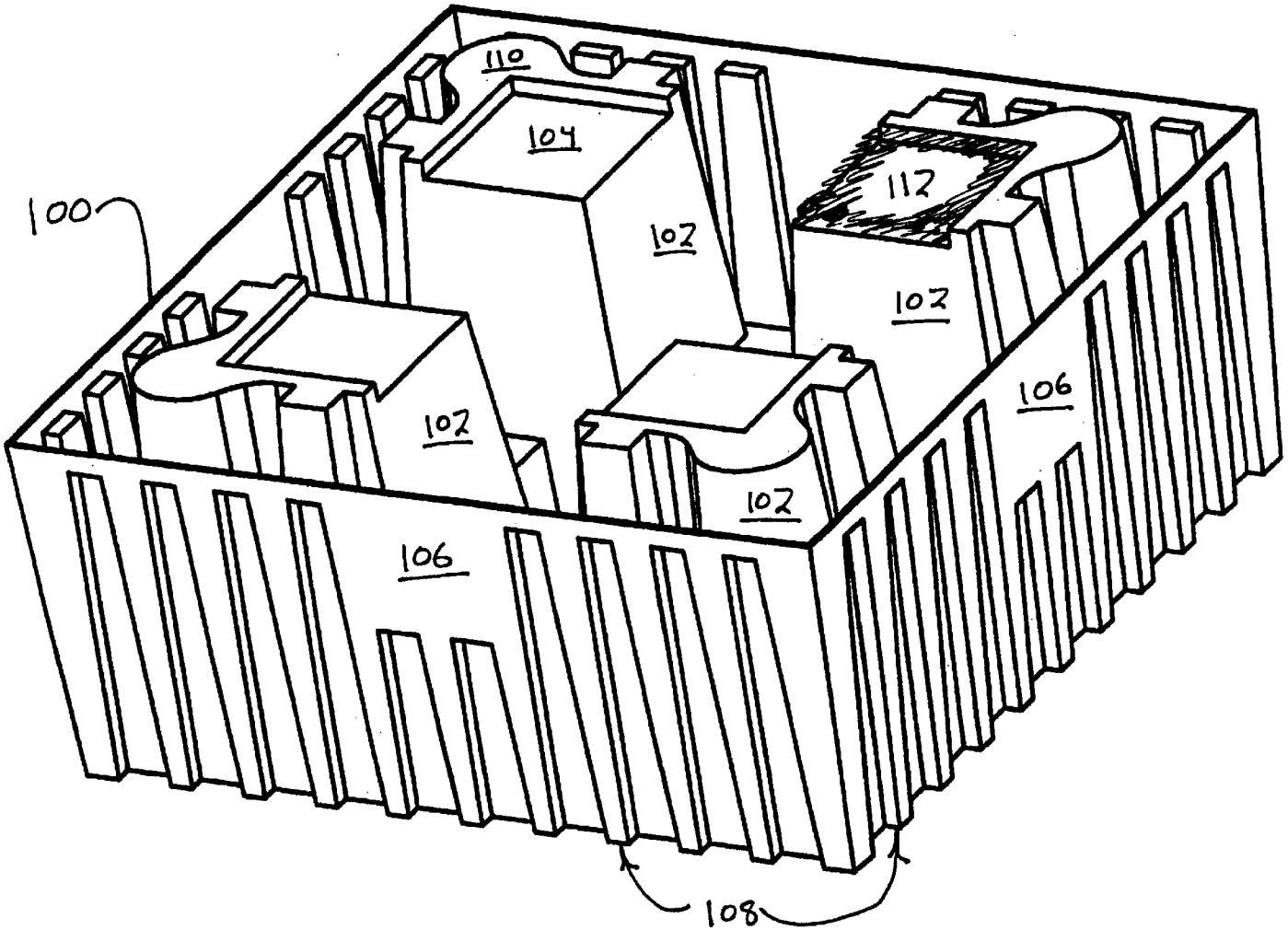
FIG. 1 is a perspective top view of an exemplary IBC spill station built according to one aspect of the present invention.

Turning to the drawings, wherein like reference numerals refer to like elements, the invention is described in terms of specific embodiments. The described embodiments should not be taken as limiting the invention with regard to alternative embodiments that are not explicitly described herein. Specific terminology is used for the sake of clarity. However, the invention is not intended to be limited to the specific terms used, and it is to be understood that each specific term includes all its technical equivalents.

FIG. 1 shows an IBC spill station 100 built according to one aspect of the present invention. Here, one piece of, preferably, non-porous and corrosion-resistant plastic integrates the IBC support structure and the containment reservoir. In the embodiment of the IBC spill station 100 shown in FIG. 1, the IBC support structure is formed from four support columns 102 that are connected to and rise above a bottom wall. (The bottom wall is shown in later Figures.) On top of the support columns 102 are formed IBC bearing areas 104. When in use, an IBC (not shown in FIG. 1) rests on the IBC bearing areas 104 and is supported above the containment reservoir by the four support columns 102.

The containment reservoir is formed from the bottom wall and a containment wall 106 that surrounds the periphery of the bottom wall. The containment reservoir is designed to contain a spill, even if the spill is caused by a catastrophically rupturing IBC. Such a spill could involve a thousand gallons or more of corrosive liquid, weighing several tons. So that the containment reservoir as shown in FIG. 1 has comparable strength to the IBC itself, strengthening ribs 108 are formed into the containment wall 106. In one embodiment, the strengthening ribs 108 occupy almost the entire surface area of the containment wall 106.

The configuration of the containment reservoir serves multiple purposes in addition to catching spills. IBCs rarely rupture catastrophically. More commonly, an IBC develops a very slow leak. Given the size of an IBC spill station (for example, the IBC spill station 100 shown in FIGS. 1 through 5 is about six feet long on each side and is close to three feet tall), a less-than-optimally configured containment reservoir could "hide" a significant quantity of spilled liquid. Thus, a slow leak could remain undetected for quite a while leading to a loss of liquid and to a potentially hazardous situation due to noxious fumes. The containment reservoir of the IBC spill station 100, on the other hand, moves any spilled liquid to areas of the bottom wall where the spill is readily detectable by a worker who comes to dispense liquids from the IBC. (The operation of dispensing is discussed in reference to FIG. 2). Separate support grills can also hide from view small quantities of spilled liquids lying on the bottom wall. Thus, the preferred embodiments do not include such visual obstructions.

Figure 6:
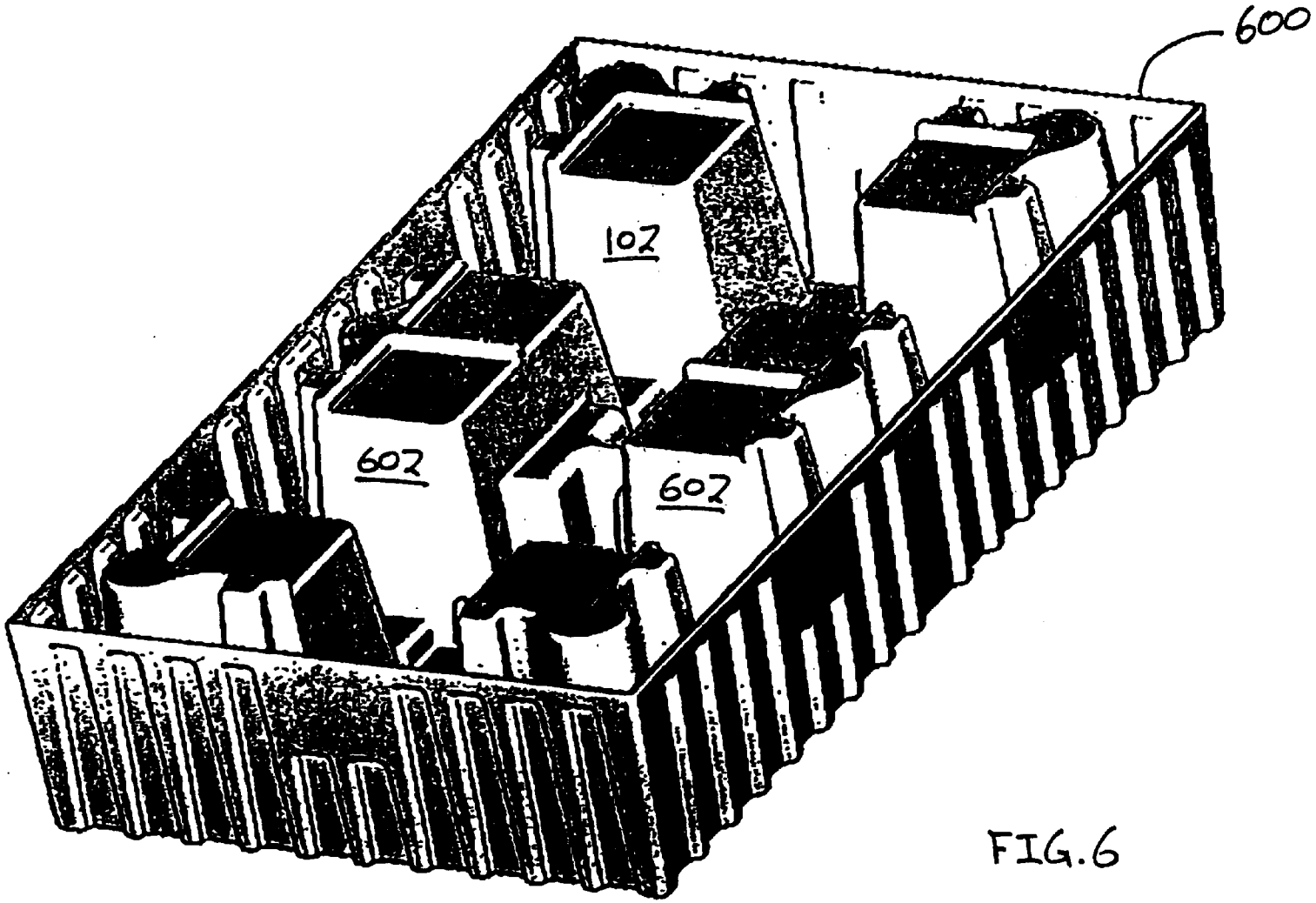
FIG. 6 is a perspective top view of a double IBC spill station according to one aspect of the present invention.
Figure 7:
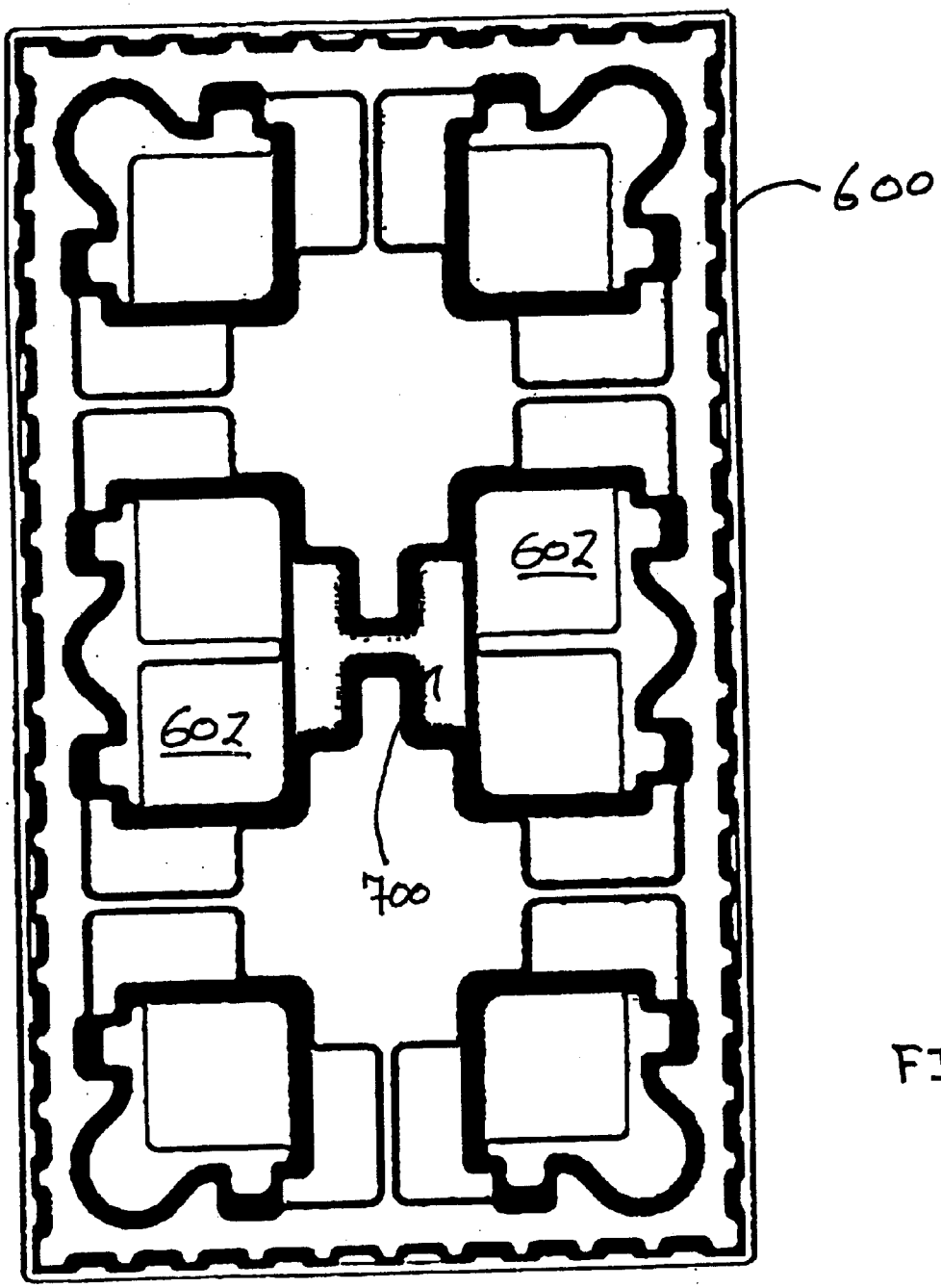
FIG. 7 is a top plan view of the double IBC spill station of FIG. 6.
Figure 8:
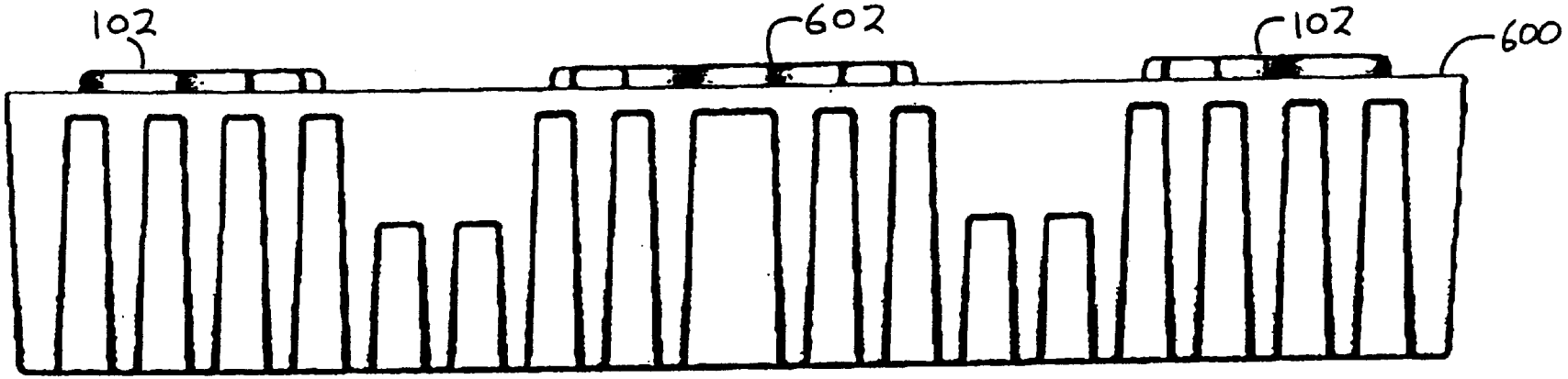
FIG. 8 is a side plan view of the double IBC spill station of FIG. 6.

In the exemplary embodiment of FIG. 1, the containment wall 106 forms a square, and the periphery of the IBC bearing areas 104 forms another square. In the preferred embodiment, the IBC bearing areas 104 match the shape of the bases of most IBCs currently in use. FIGS. 6 through 8 show an IBC spill station with a different shape, an elongated rectangle that accommodates two IBCs side by side. In other IBC spill station embodiments, the containment wall 106 and the periphery of the IBC bearing areas 104 may form other shapes, such as circles, triangles, etc. However, the size and spacing of the IBC bearing areas 104 in the spill station embodiment of FIG. 1 are configured to accommodate a large range of IBCs, even of IBCs with circular bases. There is no need to use separate IBC spill stations custom-configured for each possible size and shape of IBC.

There are four evenly spaced support columns 102 in FIG. 1, but that number varies depending upon specific requirements such as the shape and size of the intended IBC. The IBC spill station 100 could be provided with one large, central support column. As is discussed below with reference to FIG. 3, however, that arrangement is not preferred as it interferes with forklift placement of an IBC on the spill station 100. Even if the periphery of the IBC bearing areas 104 were shaped to closely fit the circular base of an IBC, there would still preferably be four support columns 102 rather than one central one. In any case, the bearing areas as in 104 of FIG. 1 could be designed to accommodate a particular size and shape of an IBC.

On each support column 102, a sighting ridge 110 is shown rising above and surrounding two sides of the IBC bearing area 104. The sighting ridges 110 are used by a forklift operator when loading an IBC onto the IBC spill station 100. The sighting ridges 110 serve as visual indications that the IBC is resting squarely on the IBC bearing areas 104. As described with respect to other aspects of the shape of the IBC spill station 100, the particular shapes of the sighting ridges 110 and of the IBC bearing areas 104 can be varied with the shape of the IBCs intended to be used with the spill station 100, however, such variation is usually not necessary.

Figure 2:
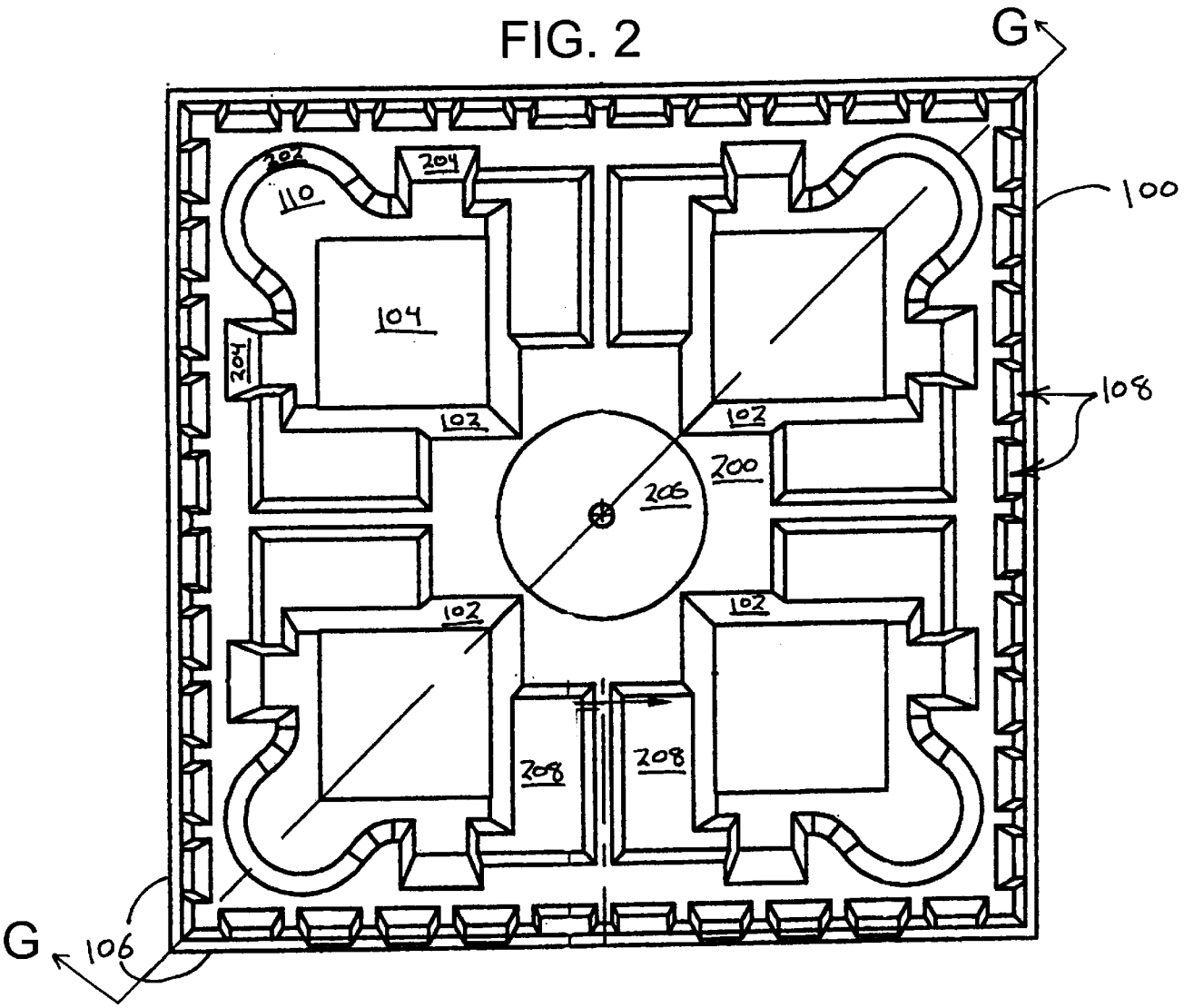
FIG. 2 is a top plan view of the IBC spill station of FIG. 1.

FIG. 2 is a top plan view of the IBC spill station 100. In this view, the four support columns 102 are seen rising from the bottom wall 200. Each of the support columns 102 is designed to safely support one quarter of the weight of a fully loaded IBC. The support columns are designed for strength, for rigidity, and to spread the weight of an IBC over a large area of the bottom wall 200. A support column 102 is given strength and rigidity in part by vertically angling its wall so that the circumference of the support column 102 measured at its base, where it connects to the bottom wall 200, is larger than a circumference measured at the top of the support column 102, near the levels of the IBC bearing area 104 and the sighting ridge 110. The angled wall also serves to spread out the IBC weight as does the curved "buttress" shape 202 of that portion of the wall of the support column 102 farthest from the center of the IBC spill station 100. Strengthening ribs 204 add additional strength and rigidity to the support column 102. Similar strengthening ribs 108 are provided in the containment wall 106 to increase strength.

The bases of the support columns 102 where they join the bottom wall 200 are so large that they can easily obscure the view of the bottom wall 200, especially when a large and opaque IBC is sitting on the IBC bearing areas 104. As noted above with reference to FIG. 1, a mostly unobstructed view of the bottom wall is important for detecting slow leaks. Thus, the center portion 206 of the bottom wall 200 may be raised (as is shown more clearly in FIG. 4) to prevent spills from "hiding" in the portion of the bottom wall 200 farthest from the containment wall 106. This raised center portion 206 also strengthens the bottom wall 200, acting in a manner similar to that of the curved buttress 202 of the wall of the support column 102. In addition, the bases of the support columns 102 do not extend to the containment wall 106. This helps to maintain flow paths to the front of the bottom wall 200 where the spilled liquid may be detected.

The IBC spill station 100 is also designed to contain spills that occur during dispensing. Rising from the bottom wall 200, between a pair of support columns 102, is formed a dispensing station that consists of two pail support platforms 208. To fill a pail, a worker puts the pail in the containment reservoir by lifting the pail over the containment wall 106. The pail rests on the pail support platforms 208 while liquid is dispensed. Any spill is caught in the containment reservoir.

In some embodiments, the pail support platforms 208 form portions of the wall of a support column 102, acting like larger versions of the strengthening ribs 204. The dispensing station is formed of two separate pail support platforms 208 rather than one in order not to block spilled liquids from flowing along the bottom wall 200 to the containment wall 106 for visual detection. Also, the gap between a pair of pail support platforms 208 allows some view to the bottom wall 200 in the center of the IBC spill station 100 for the purpose of detecting a small spill.

The exemplary IBC spill station 100 of FIG. 2 has four dispensing stations: one on each side of the spill station 100. In the case where an IBC has more than one faucet, more than one dispensing station may be used at the same time. Much more likely is the case where the IBC has only one faucet. Then, the multiple dispensing stations are useful in preventing the extra work of aligning the IBC spill station 100 before placing an IBC onto it. Dispensing stations not under the IBC's faucet may also be used to hold additional pails, empty or full, until they are needed.

Figure 3:
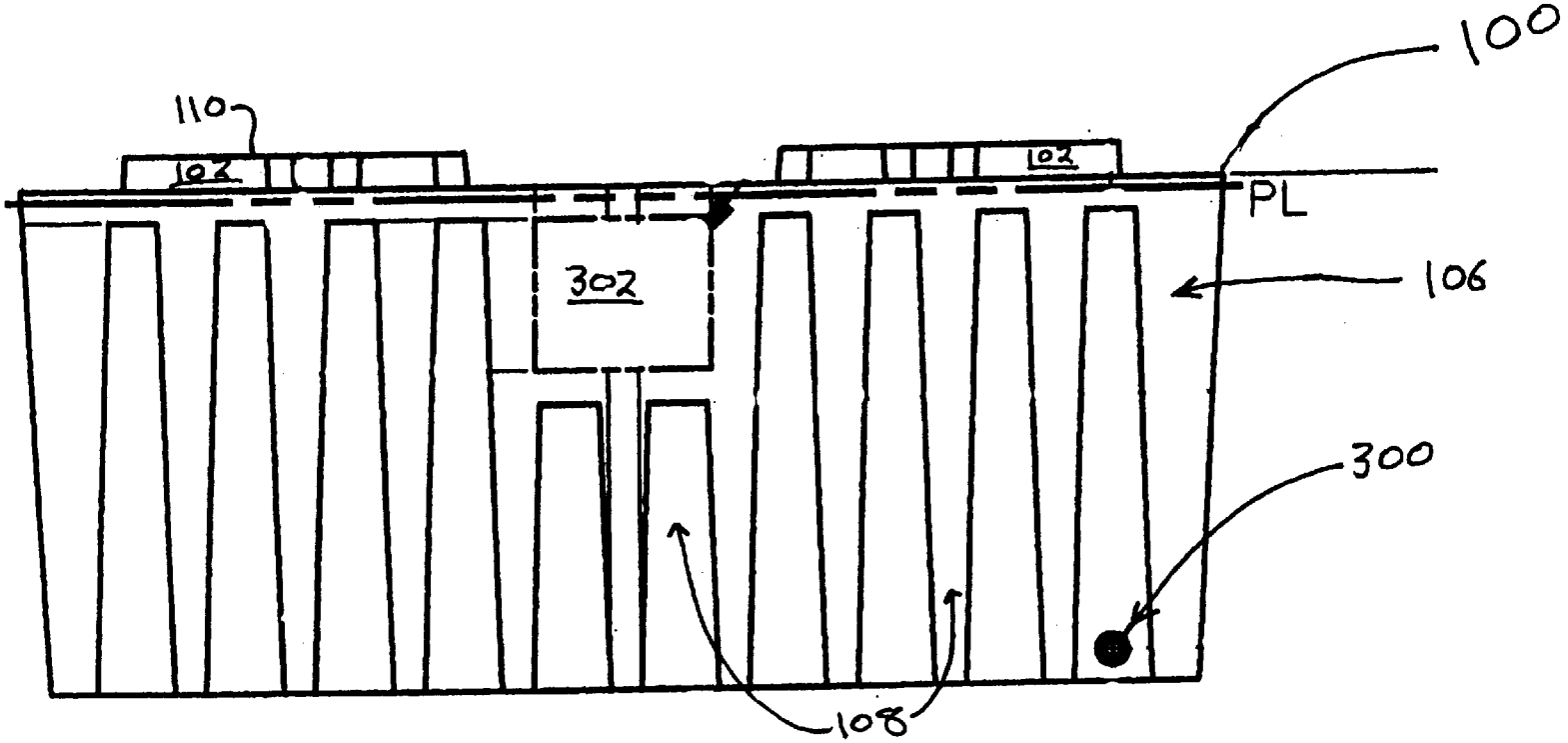
FIG. 3 is an end plan view of the IBC spill station of FIG. 1.

FIG. 3 is an end plan view of the IBC spill station 100. The support columns 102 are shown rising above the top of the containment wall 106. Shown more clearly in the cross-sectional view of FIG. 4, the level of the IBC bearing areas 104 is above the top of the containment wall 106 and the sighting ridges 110 rise slightly above the bearing areas 104. The gap between the top of the containment wall 106 and the level of the IBC bearing areas 104 is very important because fully loaded IBCs (which can weigh several tons) are placed onto the IBC spill station 100 by means of a forklift. Having picked up the loaded IBC with a forklift, the forklift operator looks at the sighting ridges 110 in order to place the IBC properly onto the IBC bearing areas 104. Once the IBC is firmly in place, the gap between the level of the IBC bearing areas 104 and the top of the containment wall 106 provides room for the forklift's tines to be removed. The spacing between the support columns 102 is also designed to provide room for the forklift's tines. The four sides of the exemplary IBC spill station 100 of FIGS. 1 through 5 are essentially symmetrical to allow forklift positioning from any side.

One difference among the four sides of the exemplary IBC spill station 100 is the placement of the drain aperture 300, shown in FIG. 3 near the base of the containment wall 106. While a similar aperture 300 could be let through each side of the containment wall 106, typically only one aperture 300 is provided. The details and functions of the drain aperture 300 are discussed further in reference to FIG. 5.

Seen clearly in FIG. 3 is the "draft angle" of the containment wall 106. The containment wall 106 angles in towards its base at an angle of, typically, 3 degrees. Unlike the angles of the walls of the support columns 102 (discussed above in reference to FIG. 2), however, the draft angle of the containment wall 106 has little to do with added strength or with weight distribution. Instead, this draft angle is useful during the manufacture of the IBC spill station 100, as is discussed further below.

Near the top center of the outer face of the containment wall 106 is a smooth area 302, devoid of strengthening ribs 108. It provides a place for a label presenting information about the manufacturer, materials, characteristics of use, and safety considerations of the IBC spill station 100. The label may be molded into the IBC spill station 100 during manufacture, may be affixed later, or may include a combination of both. The following discussion presents a few examples of the importance of this information.

The IBC spill station 100 of FIGS. 1 through 5 has been carefully designed to safely bear up to 8000 pounds which means that it can hold two IBCs stacked one on top of the other. Its containment reservoir has a capacity of 400 gallons. Due to the size and spacing of the IBC bearing areas 104, the exemplary IBC spill station 100 can accommodate IBCs whose bases range in size from 24 inches square to 48 inches square.

If the IBC spill station 100 were to be built of linear low density polyethylene, a material preferred for its toughness and its resistance to corrosion, then the IBC spill station 100 should only be used in a temperature range of 0 to 120 degrees Fahrenheit. At temperatures below 0°, the polyethylene may become brittle and non-resilient to bumps from forklifts and the like. At temperatures above 120°, the polyethylene loses some rigidity and may begin to give way under the weight of the IBC. The IBC spill station 100 may be built of other materials, of course, with different temperature characteristics.

In the preferred embodiment, the IBC spill station 100 has no channels beneath it for forklift tines. This is intended to prevent a forklift operator from moving the IBC spill station 100 with an IBC stacked on top of it. While these channels can be provided in some embodiments, molded under the bottom wall 200, they interfere with the free flow, and therefore with the detection, of small amounts of spilled liquids. Further, they are not necessary in order to move the IBC spill station 100 when empty. Even without forklift channels, the empty IBC spill station 100 is easily manipulated by forklift. (Weighing nearly 300 pounds empty, the IBC spill station 100 should not be lifted without a forklift but can be pushed around the shop floor by a single worker.) Factory tests have shown that a stack containing an IBC upon a spill station 100 is far too unstable to be safely moved together. Without the forklift channels under the IBC spill station 100, a forklift operator is forced to safely move the IBC separately from its spill station 100.

The IBC spill stations 100 allow nested stacking. While nested stacking may be preferable to save space, factory tests have shown that, once nested, it can be very difficult to remove one empty IBC spill station 100 from another. This is due primarily to their large size and weight.

Figure 4:
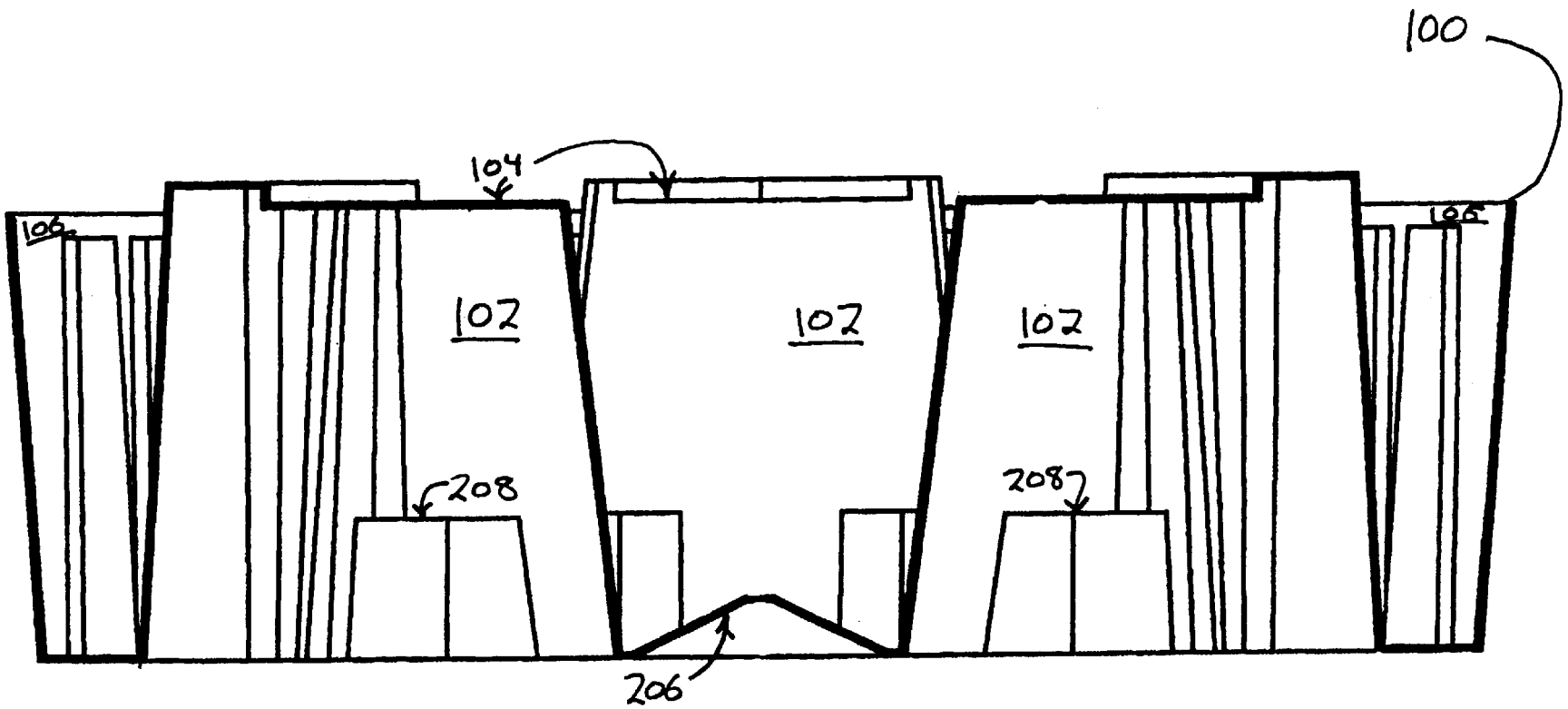
FIG. 4 is a cross-sectional view of the IBC spill station of FIG. 1 through section G—G of FIG. 2.

FIG. 4 is a cross-sectional view of the IBC spill station 100 through section G—G of FIG. 2. As an internal view, it clarifies some of the features of the IBC spill station 100 that are discussed above. In particular, the angled walls of the support columns 102, formed to strengthen the support columns 102 and to spread the weight of an IBC, are clearly shown. In between the support columns 102 is the raised portion 206 at the center of the bottom wall 200, designed both to strengthen the bottom wall 200 and to prevent spilled liquids from "hiding" in the middle of the IBC spill station 100. FIG. 4 also depicts the small gap between the level of the IBC bearing areas 104 and the top of the containment wall 106 which allows a forklift to place or remove an IBC onto the bearing areas 104.

FIG. 4 shows how far the pail support surfaces 208 of the dispensing stations rise above the bottom wall 200. These surfaces are made low enough so that a pail falling over would spill its contents into the containment reservoir. The pail support surfaces 208 are, at the same time, made high enough to ease the lifting of a filled pail over the top of the containment wall 106 and to prevent the pail from resting in any accumulation on the bottom wall 200 of the IBC spill station 100.

Figure 5:
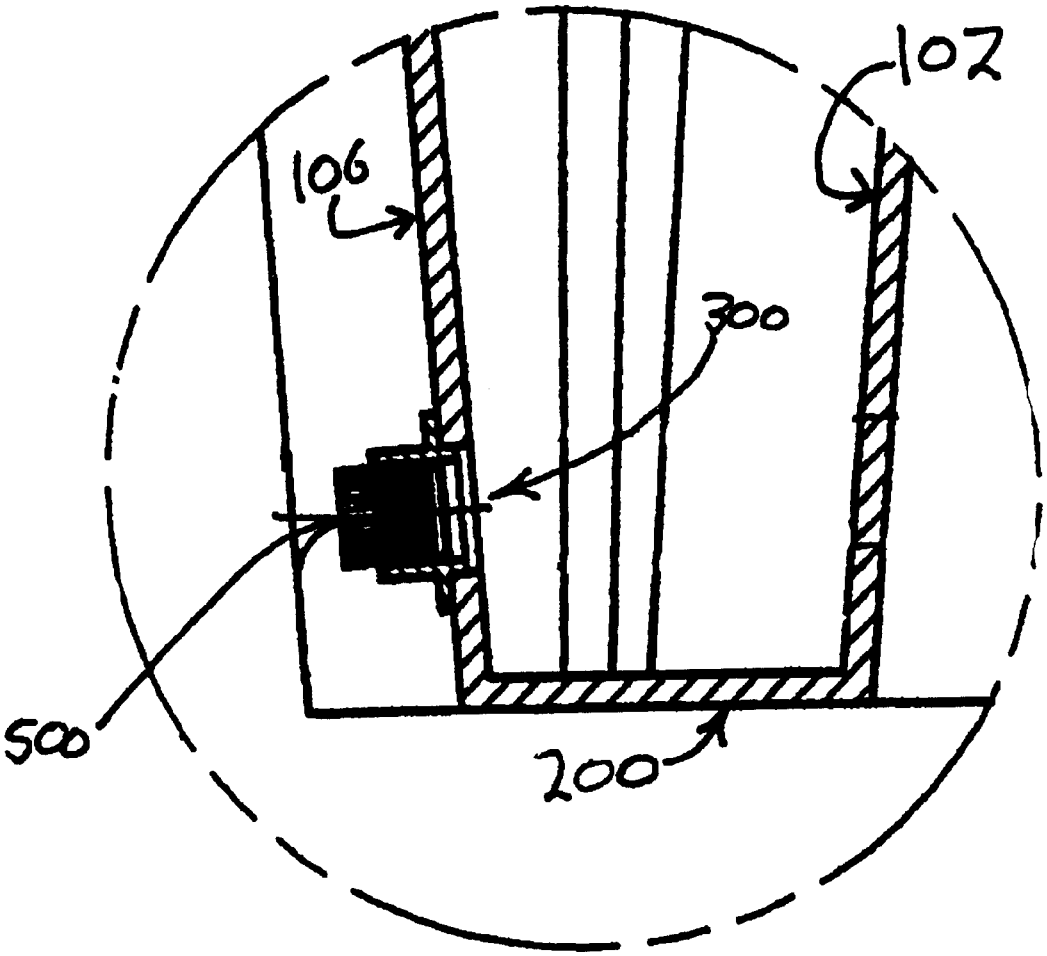
FIG. 5 is a detail view of a drain aperture in an IBC spill station according to an embodiment of the present invention.

FIG. 5 is a detail of the drain aperture 300 in the containment wall 106. A removable plug 500 seals the aperture. When the containment reservoir holds liquid spilled from an IBC, the plug 500 is removed and the spill is drained off. Usually, after the spill drains off, the IBC spill station 100 is rinsed out and the rinsing fluid (often water) drains through the aperture. Because the IBC spill station 100 has no separate support grill, there is no need to remove an in-place IBC when rinsing out the spill station 100. Some installations may prefer not to use a plug 500, but instead run a hose from the drain aperture 300 to a spill collection tank so that spills are immediately drawn off. the drain aperture 300 is an optional feature of the IBC spill station 100 because spills can be pumped out over the top of the containment wall 106.

Another optional feature of the IBC spill station 100 is the bearing pad 112 illustrated in FIG. 1. Though each of the IBC bearing areas 104 would include a bearing pad 112 in practice, only one bearing pad 112 is shown in FIG. 1. The bearing pad 112 is made of a firm, rubber-like compound and conforms to the base of an IBC (which can be somewhat pointy) to spread the weight of the IBC over the IBC bearing area 104. The flexibility of the bearing pad 112 also provides a slight cushion to the IBC spill station 100 and to an IBC when the IBC is loaded onto the IBC spill station 100 by a forklift. The bearing pad 112 is made of a material with a higher coefficient of static friction than that of the slightly slippery material (e.g., polyethylene) typically used in making the remainder of the IBC spill station 100 and thereby assists in the precise placement of the IBC.

Illustrating another possible spill station configuration, FIG. 6 is a perspective top view of a double IBC spill station 600 built according to one aspect of the present invention. The double IBC spill station 600 bears two IBCs side by side, saving some floor space over an arrangement of two single IBC spill stations 100. Most aspects of the single IBC spill station 100 of FIGS. 1 through 5 discussed above apply as well to the double IBC spill station 600. For example, the four support columns 102 in the corners of the double IBC spill station 600 can be identical to those in the single IBC spill station 100. In the embodiment of FIG. 6, there are two central support columns 602, each of which supports one corner of each of two IBCs.

Of course, these two central support columns 602 must be enormously strong, able to bear up to two tons. FIG. 7 is a top plan view of the double IBC spill station 600 of FIG. 6 and clearly shows the curved buttresses and strengthening ribs of these central support columns 602. Note that the structure 700 between the two central support columns 602, while shaped like the pail support platforms 208 of a dispensing station, is not readily accessible for dispensing liquid from either IBC. Not a dispensing station at all, the structure 700 instead provides additional strength and rigidity to the central support columns 602.

Early leak detection is especially important for the double IBC spill station 600 because there are now two possible sources of a spill, and leaked liquid may have to travel a greater distance before it reaches a location suitable for visual detection. In some embodiments, it makes sense to divide the containment reservoir of the double IBC spill station 600 into two separate reservoirs. This helps to quickly identify which IBC is the source of a leak. Of course, with separate reservoirs, a drain aperture 300 may be provided for each.

FIG. 8 is a view of the longer side of the double IBC spill station 600 of FIG. 6 (the shorter side may look identical to the view of FIG. 3). Given how closely the two IBCs sit, the slippage-prevention qualities of the bearing pads 112 are very important when a forklift operator loads an IBC next to one already in place.

IBC spill stations built according to aspects of the present invention may be manufactured using industry-standard techniques. IBC spill stations are preferably formed from a non-porous, corrosion-resistant material such as linear low density polyethylene (LLDPE). Because of the size and complexity of these spill stations, rotational molding is the preferred manufacturing process. In rotational molding, pellets of the IBC spill station material are placed between two mold halves. The mold halves are clamped together to form a mold assembly which is placed in an oven. In the oven, the mold assembly is heated to melt the pellets and, at the same time, the mold assembly is rotated in two or more dimensions. The rotation forces the melted material into all parts of the mold assembly. As is known in the industry, shields or directed hot air may be used to achieve preferred thicknesses (0.3 inch for most walls, 0.315 inch for the walls of the support columns 102). The mold assembly is then removed from the oven.

After removal from the oven, the mold halves are separated. The mold half that still contains the newly-formed IBC spill station is then turned upside down. If the containment wall 106 were formed to be vertical, then the friction between it and the mold half would greatly hinder the removal of the IBC spill station from the mold. Therefore, the containment wall 106 is formed with the slight draft angle noted in reference to FIG. 3.

If a drain aperture 300 is desired, it may be machined into the containment wall 106 and a drain fitting spin welded into place. Bearing pads 112 are added if desired. The dimensions shown in the Figures are measured after cooling: LLDPE may shrink about 3%.

In view of the many possible embodiments to which the principles of this invention may be applied, it should be recognized that the embodiments described herein with respect to the Figures are meant to be illustrative only and should not be taken as limiting the scope of the invention. For example, the specific measurements in the Figures are typical for a particular application: other measurements are desirable for other applications. Therefore, the invention as described herein contemplates all such embodiments as may come within the scope of the following claims and equivalents thereof.

We claim:

1. A one-piece spill station for holding an intermediate bulk container (IBC) comprising:

a bottom wall which is substantially rectangular;

a containment wall connected to and rising substantially vertically from a peripheral region of the bottom wall, the containment wall and the bottom wall forming a containment region, the containment wall further including a plurality of strengthening ribs molded into the containment wall for providing structural strength to contain a complete spill of an IBC's contents;

at least four support columns connected to and rising substantially vertically from the bottom wall within an area inside of the containment wall, each of the support columns including a wall with at least one strengthening rib molded substantially vertically therein;

generally horizontal IBC bearing areas formed in the support columns and disposed distally from ends of the support columns that connect to the bottom wall, the IBC bearing areas together capable of supporting a load of at least 8000 pounds; and IBC alignment areas formed in the support columns and disposed distally from the ends of the support columns that connect to the bottom wall, the IBC alignment areas formed by ridges that provide guidance to align an IBC with the IBC bearing areas, the ridges generally forming an outline of corners of a rectangle, the IBC bearing areas being disposed sufficiently far above at least a portion of a top edge of the containment wall to allow tines of a forklift to move in and out of position to place an IBC onto the IBC bearing areas.

2. The one-piece spill station of claim 1 further comprising:

a drain aperture through the containment wall.

3. The one-piece spill station of claim 1 wherein the containment wall comprises:

an area on an outside face of the containment wall free from strengthening ribs and usable for holding an information notice.

4. The one-piece spill station of claim 1 further comprising:

a dispensing station, the dispensing station comprising a pail support platform connected to and rising above the bottom wall, a connection of the pail support platform to the bottom wall located within an area defined by the peripheral region of the bottom wall, the pail support platform adapted to holding a pail while dispensing liquid from an IBC.

5. The one-piece spill station of claim 1 further comprising:

a bearing pad resting on a top surface of an IBC bearing area, the bearing pad formed of a material with a higher coefficient of static friction than that of a material forming the top surface of the IBC bearing area.

6. The one-piece spill station of claim 1 wherein a support column wall is angled away from vertical so that a circumference of a support column measured at a level of the bottom wall is greater than a circumference of the support column measured at a level of a top surface of an IBC bearing area.

7. The one-piece spill station of claim 1 wherein the containment wall and the support column walls are angled away from vertical to ease removal of the one-piece spill station from a manufacturing mold.

8. The one-piece spill station of claim 1 wherein the bottom wall comprises a raised portion near the center of the bottom wall.

* * * * *